United States Patent [19]

Allain

[11] 4,252,559

[45] Feb. 24, 1981

[54] PROCESS FOR PROCESSING CAST IRON SUITABLE FOR FOUNDRY MOULDING

[75] Inventor: Christian P. M. Allain, Maidieres, France

[73] Assignee: Pont-a-Mousson S.A., Nancy, France

[21] Appl. No.: 862,327

[22] Filed: Dec. 20, 1977

[30] Foreign Application Priority Data

Dec. 23, 1976 [FR] France ..... 76 38956

[51] Int. Cl.[3] ..... C22C 37/00

[52] U.S. Cl. ..... 75/11; 75/40; 75/48; 75/130 R

[58] Field of Search ..... 75/130 R, 12, 48, 11, 75/38, 40

[56] References Cited

U.S. PATENT DOCUMENTS 2,855,336 10/1958 Curry ..... 75/130 R 3,042,513 7/1962 Crome ..... 75/130 R

*Primary Examiner*—M. J. Andrews

*Attorney, Agent, or Firm*—Sughrue, Rothwell, Mion, Zinn and Macpeak

[57] ABSTRACT

The process comprising supplying an electric arc furnace with ferrous products and fluxes so as to form a bath of metal and slag and adding carbon to the bath of metal. The ferrous products are pre-reduced ores which are continuously introduced into the furnace between the electrodes of the furnace in the course of the formation of the bath. A carburizing agent is introduced to bring the carbon content of the bath to a value between 1.7 and 6.7%. Thereafter, the slag is removed. If desired, the carbon content of the cast iron can be brought to the desired value by adding further carburizing agent. The cast iron is then poured from the furnace.

2 Claims, 2 Drawing Figures

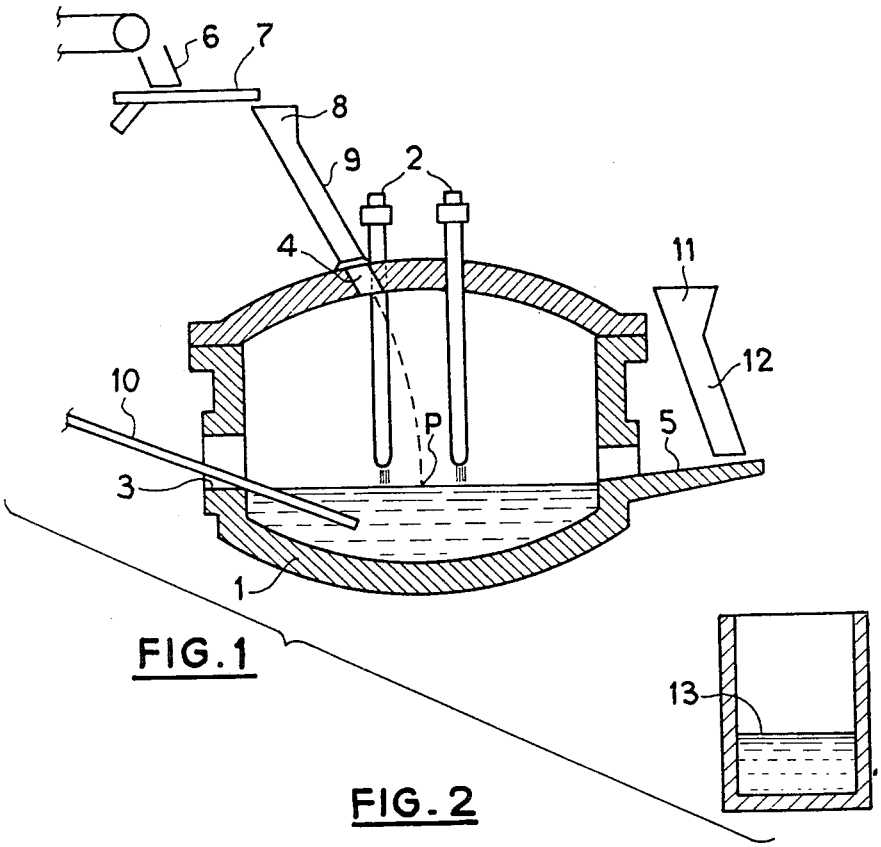
FIG. 1
FIG. 2
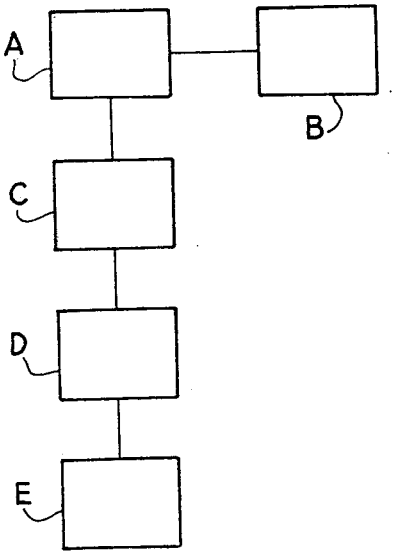

PROCESS FOR PROCESSING CAST IRON SUITABLE FOR FOUNDRY MOULDING

The present invention relates to the processing of base cast iron or pig iron from pre-reduced iron ore which may be employed for foundry moulding either directly as a first melt or as a second melt after putting the cast iron of the first melt into the form of an ingot.

The electric arc furnace has been employed for producing steel from pre-reduced iron ore or sponge iron. Such a process is disclosed in French Pat. No. 1,481,142. Only the processing of steel having carbon contents of 0.40 to 0.50% is disclosed therein.

Although it is rare to use it for producing cast iron for moulding, the use of the electric arc furnace is principally known for the second melt, that is to say, the remelting of ingots or cast iron parts.

French Pat. No. 487,844 discloses a process for processing cast iron from iron or steel in an electric furnace comprising introducing fluxes so as to form a slag on the surface of the molten iron and a carbonaceous material either when charging the metal or during or after the melting operation. This patent only concerns the production of cast iron from products which have already been processed, namely iron or steel.

German Pat. No. 954,699 furthermore discloses a process for melting ferrous products in an arc furnace, comprising introducing a part of the total charge then, when the mass introduced has melted, introducing the remainder of the charge. This patent does not concern the processing of cast iron and employs as ferrous products only the products which have already been thoroughly processed, including the cast iron itself.

An object of the present invention is to provide a solution of the problem of the supply of liquid cast iron which is as flexible as possible to foundries from supplies of pre-reduced iron ores having relatively variable iron compositions. A flexible supply is intended to mean a continuous or intermittent supply and the production at will of small, medium or large amounts of cast iron for moulding by the use of one or more melting apparatus in accordance with needs.

The Applicant has found that it is possible to employ an electric arc furnace for processing base cast iron or pig iron from pre-reduced iron ore.

It must be understood that the percentages mentioned in the specification and claims are percentages by weight unless otherwise indicated.

According to the invention, there is provided a process for processing base cast iron of the type comprising supplying an electric arc furnace with ferrous products and fluxes so as to form a metal bath and a slag and of the type comprising adding carbon to the bath of metal, wherein the ferrous products are pre-reduced ores which are continuously introduced between the electrodes of the furnace in the course of the formation of said bath, and a carburizing agent is introduced so as to bring the carbon content of the bath of metal to a value between 1.7 and 6.7% and thereafter the slag is removed by a cleaning operation in the known manner, and if required the carbon content of the cast iron is brought to the desired value by addition of carburizing agent and the cast iron is poured.

Owing to the use of an electric arc furnace, in one or several units, and to the intrinsic possibilities of this melting apparatus, the problem of the flexibility of the supply of liquid cast iron is solved.

Also owing to this apparatus, it is possible to employ pre-reduced iron ores the iron content of which may vary within relatively wide limits, for example but not exclusively from 60 to 90%.

Furthermore, the difficulties of the enriching of the bath of metal with carbon has been overcome.

Indeed, in the course of the melting of the pre-reduced products which usually contain a variable proportion of iron oxide and carbon, there is observed a more or less intense emanation of carbon from the reaction of the reduction of the iron oxides by the carbon.

Usually, in the case of a carbon content of the bath of metal lower than about 0.5%, this reaction may be controlled by the rate of supply of the pre-reduced products. In this way, there is avoided an excessive emanation of carbon monoxide in one go in the form of bubbles, which causes the bath to bubble.

A priori, it might be feared that there occur, in the course of the use of baths of metal having more than 1% of carbon, a temporary blocking of the aforementioned reaction of reduction of the residual iron oxides of the pre-reduced ores, followed by a violent recommencement of this reaction which would constitute a high risk of the liquid metal being thrown out.

Unexpectedly, the Applicant in exceeding the aforementioned carbon contents of the bath of metal, since the carbon contents of the bath of metal were raised beyond 1.7%, discovered that the reaction of the reduction of the residual iron oxides by the carbon, very often named decarburization, could be controlled, even with carbon contents of the bath of metal exceeding 1.7%. Consequently, it has been found possible to add a large amount of carbon when charging and during the melting.

The process of the invention for obtaining a high carbon percentage in the processed cast iron has the advantage, in the case where the chemical analysis of the pre-reduced products is good, of increasing the productivity of the furnace by carrying out a part of the carburization of the metal in concealed time, that is to say with no need for additional time, and decreasing the overall electric power consumption per ton of cast iron produced, while retaining a satisfactory yield of carbon.

As mentioned above, the process of the invention comprises a main carburizing stage, in the course of the formation of the bath of metal and, if need be, an additional carburizing stage, after cleaning. This additional stage is of course unnecessary if the desired carbon content is obtained at the end of the first carburization.

However, in order to obtain cast irons having carbon contents above 3.5%, it is advantageous to carry out the carburization in stages since a higher overall yield of carbon is then obtained. Indeed, in the course of the melting of a bath of metal with high carbon contents, there is a relatively high loss of carbon by oxidation.

The process of the invention may be followed by a post-treatment which comprises putting the cast iron into the final grade by adding, in the course of the pouring from the furnace, certain elements such as silicon, in the cast iron flowing in the pouring channel of the furnace.

It is also possible to subject the cast iron obtained in accordance with the process of the present invention to a nodularizing treatment so as to obtain ductile or spheroidal graphite cast irons for cast parts.

Pearlitizing agents may also be added to the cast iron.

Further features and advantages of the invention will be apparent from the ensuing description with reference to the accompanying drawing which is given solely by way of example and in which:

FIG. 1 is a diagrammatic sectional view of an apparatus for carrying out the process according to the invention, and FIG. 2 is a block diagram of the different stages of the process of the invention.

The apparatus for carrying out the process of the invention shown in FIG. 1 comprises:

(a) A three-phase electric arc furnace 1 of the tiltable type having three electrodes 2 (only two of which have been shown owing to the sectional view). This furnace has a slag-removing or cleaning opening 3 which may also be used for the introduction of a blowing nozzle employed in the process of the invention for injecting powders. A supply or charging opening 4 is provided in the vault of the furnace. The furnace is provided with a pouring channel 5.

(b) A unit for continuously supplying pre-reduced products comprising, apart from storage hoppers (not shown), a fixed feeding device 6 and a detachable feeding device 7, a receiving chute 8 extended by an inclined tube 9 which extends through the supply opening 4 so that the pre-reduced ores introduced in the furnace 1 by way of the tube 9 have a point of impact P located between the three electrodes 2.

(c) A powder injecting device, only a blowing nozzle 10 of which is shown here in the blowing position extending through the slag-removing or cleaning opening 3 of the furnace.

(d) A post-treating device, that is to say a device for a final supply of additional elements to the cast iron at the outlet of the furnace 1. This device is placed above the pouring channel 5 and comprises a chute 11 extended by a tube 12 whereby it is possible to pour into the channel the addition elements for obtaining the final composition of the cast iron, that is to say, the putting of the cast iron into the desired grade, when pouring into the ladle 13. These elements for example consist of ferro-silicon.

By means of this apparatus and in accordance with the invention, a base cast iron suitable for moulding purposes in a foundry is produced in the following manner (FIG. 2):

Stage pertaining to the supply of pre-reduced ore and the melting of the ore (A), and at least partial carburization of the bath of metal (B).

A—Starting with a furnace 1 containing possibly and optionally a bath puddle, that is to say, still containing in the bottom thereof liquid cast iron to a shallow depth relative to the total height. This could have been conserved following on the preceding pouring when it then has a carbon content identical to that obtained at the end of the production or could be constituted by the prior melting in the arc furnace of a certain proportion of pre-reduced ores to which there will have been added in the charge the carbon necessary for obtaining the desired carbon content of the bath of metal.

The electric furnace 1 being in operation at the desired power thereof by means of the feeding system 6 and 7, the chute 8 and the tube 9, the furnace 1 is continuously supplied with pre-reduced ores (in pieces, balls or agglomerates) containing essentially metallic iron, a small amount of iron oxides, silica, alumina, carbon and, in still smaller percentages, elements such as: phosphorus, sulphur, manganese, chromium, vanadium, titanium and other mineral elements usually contained in iron ores.

By means of the feeding device 6, the supply of pre-reduced ores is so regulated as to obtain the desired temperature of the bath of metal being formed.

In the known manner, and by means of a blowing nozzle 10, fluxes (chalk, dolomite, fluor-spar) are introduced in addition to the pre-reduced products so as to form a more fluid slag which has the desired basicity characteristics (the basicity characteristics are represented by the ratios:

$$CaO/SiO_2 \text{ and } (CaO+MagO)/(SiO_2+Al2O_3)$$

The fluxes may be introduced in the following manner: A first half at the start of the continuous supply of pre-reduced ores, and the other half at about the middle of this continuous supply.

By way of a modification, when it has not been possible to converse a bottom puddle, instead of supplying pre-reduced iron ores continuously to the arc furnace 1, the latter being regulated at the maximum of the power thereof, it is possible to start with a charging of about 20% of the pre-reduced iron ores relative to the total charge of pre-reduced iron ores to be introduced, while regulating the furnace 1 at low power and, when this first mass introduced has melted, to complete as in the principal manner of carrying out the invention, by a continuous supply of about 80% of the total charge of pre-reduced products by regulating the furnace 1 at its maximum power.

B—The main carburization stage takes place during the aforementioned ore supply operations A.

It consists of a carburization of the bath of metal:

either by introducing into the furnace by a continuous charging by way of the chute 8 and the tube 9, pieces of carburizing agent (graphite, coal, coke) the particle size of which is generally between 5 and 10 mm, or by injecting intermittently a carburizing agent powder (graphite, coal, coke) by way of the nozzle 10 and an apparatus known per se. The particle size of the powder is chosen in accordance with the equipment available and is usually below 5 mm.

In accordance with the chemical analysis of the pre-reduced products employed, and that desired for the final cast iron as concerns the residual elements in particular, (chromium, manganese, vanadium for example), this carburization will be more or less extensive so as to limit the reduction of the oxides of said residual elements by the carbon.

Should the chemical analysis of the pre-reduced ores and the desired cast iron be compatible, this first carburization may be made to exceed a 2.5% carbon content of the bath. Indeed, unexpectedly, the phenomena of delay of the "decarburization" or reaction of reduction of the residual oxides (oxides of iron or oxides of other elements) do not occur. This is due to the continuous supply of these oxides by the continuous charging of pre-reduced ores by way of the chute 8 and the tube 9 above the zone of the electrodes where the fusion-reduction occurs.

Cleaning stage: C

At this stage, a cleaning is carried out, either merely by tilting the furnace 1 rearwardly or, in addition, by means of a scraping-plane so as to obtain a bath having no slag. This choice between the two methods depends again on the analysis of the pre-reduced ores employed, and on that desired for the final cast iron, particularly as concerns the residual elements. In particular, all the slag will be removed when a subsequent reduction by the carbon of the phosphorus, chromium, manganese, and vanadium oxides for example present in the slag is to be feared.

Additional carburization stage: D

As an addition to the carburization when charging (stage A-B), the carbon content of the cast iron already contained in the furnace 1 may be adjusted by means of a blowing nozzle similar to the nozzle 10 which is capable of supplying a re-carburizing agent powder (this adjustment of the carbon content presupposes that a sample had been taken for analyzing the carbon subsequent to stage A-B).

In other words, the carburization is carried out generally in two stages: firstly roughly (A-B), which permits, in the case of suitable chemical analysis of the prereduced ores, possibly rather closely approaching the final carbon content envisaged for the cast iron, and secondly finely (D), which enables the envisaged carbon content to be finally reached.

Pouring and possible post-treatment stage: E

The pouring is carried out by tilting the arc furnace 1. The cast iron is poured into the channel 5. Instead of completely emptying the arc furnace 1 of its molten cast iron, a bottom puddle may be left, that is to say an amount corresponding to about 20% of the total content of the arc furnace may be left in the bottom of the latter.

The advantage of this is to improve the productivity of the arc furnace.

In the course of the pouring, a post treatment may be carried out, that is to say a treatment which follows on the arc furnace treatment. This post treatment which puts the cast iron into the desired grade, comprises supplying the cast iron with alloying elements required for its composition, for example silicon. These elements are advantageously poured by way of the chute 11 and tube 12 into the metal in the vicinity of the end of the pouring channel 5. The channel 5 pours the graded cast iron into the ladle 13 which would then contain a cast iron suitable for moulding.

The ladle 13 may supply the cast iron to foundry moulds directly or to ingot moulds for the purpose of a second melting or subsequent re-melting for filling moulds.

A nodulizing treatment may also be carried out on the already inoculated cast iron for moulding ductile cast iron parts.

This treatment must take place as late as possible before the parts are formed by a static casting or a centrifugal casting, that is to say as near as possible to the inlet of the foundry mould or centrifugal casting mould, in a ladle, in a channel supplying the cast iron to the static mould or the rotating mould, or even inside the static mould or rotating mould.

The nodulization may be carried out in accordance with any of the different known methods with pure or alloyed magnesium or other nodulizing agents.

An additional treatment may also be of utility, namely the introduction of a pearlitizing adjuvant which may be phosphorus, or manganese, or preferably tin or copper.

As concerns more particularly the stage A-B during which the carburization treatment is carried out by the introduction of a carburizing agent into the arc furnace, the Applicant has found that this treatment advantageously permits, in the case where the chemical quality of the prereduced products is good, increasing the productivity of the arc furnace, and reducing the overall electric power consumption per ton of cast iron produced, while ensuring a satisfactory yield of carbon.

There will be given hereafter, by way of examples, a few qualitative and quantitative data relating to tests carried out.

EXAMPLE 1

Static casting of ductile cast iron foundry parts.

(a) Raw materials introduced:

Pre-reduced ore balls of Swedish origin are used which have essentially a particle size of 10 to 16 mm and the following chemical analysis:

| | |
|---|---|
| Total iron (Fe + oxides FeO and $Fe_2O_3$) | 92.4% |
| Metallic Fe | 85.1% |
| C | 1.1% |
| $SiO_2$ | 2.02% |
| $Al_2O_3$ | 0.7% |
| CaO | 0.25% |
| MgO | 0.55% |
| P, Mn, S | <0.1% |
| Cu, Cr | <0.02% |
| V, Ti between 0.15 and 0.3%. | |

The following raw materials (per metric ton of cast iron brought to the desired grade) are employed:

| | |
|---|---|
| Pre-reduced ores | 1050 to 1200 kg |
| Lime | 30 to 45 kg |
| Dolomite | 3 to 5 kg |
| Carbon | 50 to 60 kg for a carbon content of 4% |
| Ferro-silicon having 75% of silicon | 24 to 26 kg for a silicon content of 1.9%. |

The carbon was added in stages B and D (at stage B the overall yield of carbon is about 80 to 85% and at stage D it is at the most equal to 75%).

(b) Arc furnace:

Capacity 6 to 7 metric tons

Power: 3000 KVA.

(c) Auxiliary devices for the arc furnace (FIG. 1). Devices for continuously charging the pre-reduced iron ores, injecting re-carburizing agent into the bath of metal, and injecting powdered fluxes and device for distributing alloying elements in the pouring channel.

For the further addition of graphite powder by injection in the bath of molten metal, there is employed a a device usually employed for dephosphorizing, that is to say a powder-blowing nozzle.

(d) Cast iron obtained with the arc furnace at the end of stage D.

| | |
|---|---|
| Carbon | 3.7 to 4% |
| Silicon | 1.65 to 2.10% |
| Phosphorus | less than 0.08% |
| Sulphur | less than 0.14% |
| Manganese | less than 0.07% |
| Chromium | no more than 0.013% |
| Aluminium | between traces and 0.030% |
| Vanadium | between 0.006% and 0.070% |
| Titanium | between traces and percentages of 0.008 to 0.030% |

the balance being mainly constituted by iron and very small percentages of other metals.

(e) Pouring and subsequent treatments of the cast iron.

After the cast iron has been brought to the desired grade in the channel 5, at the outlet of the arc furnace, by means of an addition element principally containing silicon, the contents of the pouring ladle are poured into a re-heating induction furnace which re-heats the cast iron to 1,500° C. and the cast iron is poured at 1,500° C. into a Teapot ladle. Then a nodulizing treatment is carried out by means of an alloy containing magnesium (Fe Si Mg ferrosilicomagnesium with or without ferrosilicomischmetal). The amount of pure magnesium thus introduced has varied in accordance with the nature of the cast parts produced and with the treatment process thus employed, from 1 kg/metric ton in the case of the so-called MAP process (French Pat. No. 1,547,409) to 1.4 kg/metric ton in the case of the "sandwich" treatment process for residual magnesium percentages of the order of 0.025% (magnesium remaining in the cast iron). Lastly, an inoculation of the cast iron is carried out just before pouring it into the moulds by the addition of a ferro-silicon alloy containing 75% of silicon (to the extent of, for example, 0.2–0.5% relative to the weight of the treated cast iron).

In this way there were moulded cast-iron grills for roadways which are perfectly sound with a yield of magnesium (ratio of magnesium introduced to the magnesium contained in the moulded cast iron) at least equal to 20% and a yield of silicon in the neighbourhood of 100%. Pipe counterflanges were also moulded with similar results.

(f) Structure and mechanical characteristics of the moulded or cast parts.

The aforementioned moulded parts (grills, counterflanges) are of ductile cast iron containing 90% of perfectly round graphite, having a nodular density (decreasing when the thickness increases as usually happens) from 350 nodules/sq.mm (for a thickness of 25 mm) to 750 nodules/sq.mm (for a thickness of 4 mm), which in fact corresponds to cast irons moulded in accordance with known methods with cast iron which has been processed in a blast-furnace, re-heated and treated.

The structure is more ferritic than pearlitic. Whereas the counterflanges are wholly ferritic, the other parts comprise from 10 to 40% of pearlite, the percentage increasing when the content of Si is lower and the content of V is higher.

Lastly, the cementite is present at least in the sensitive regions (edges of the skirt portions of the counterflanges) where it was required.

The tensile strength is between 45 and 50 daN/sq.mm. The elongation is higher than or equal to 20% and the shock resistance is higher than or equal to 1.9 daJ/sq.cm. The latter two characteristics are high.

If it is desired to accentuate the pearlitic character of the structure by exceeding the percentage of 50% of pearlite so as to exceed the value of 50 daN/sq.mm or at least reach this value, there is added a pearlitizing adjuvant such as manganese or, preferably, copper or tin, preferably in an induction heating furnace so as to render the bath homogeneous.

It has therefore been found that the ductile or spheroidal graphite cast irons obtained from cast iron processed in the arc furnace are perfectly capable of giving sound parts from the point of view of the internal soundness, the quality of the graphite and the tendency to white solidification.

EXAMPLE 2

Centrifugal casting of ductile cast iron pipes.

The procedure is as in Example 1, with the same raw materials. But instead of directly using the ductile cast iron from the ladle 13 originating from the arc furnace, the contents are poured into ingot moulds and the ingots are remelted in an induction furnace, this method having been found necessary owing to the remoteness of the arc furnace from the machines for centrifugally casting the pipes.

This re-melting moreover does not alter the quality of the first melt cast iron prepared by the process according to the invention.

Pipes of diameters 150, 200, 250, 350, 400 and 600 mm were cast in this way.

Among 135 pipes cast, 9 were rejected and the others were found to be of good quality.

(a) Analysis of the cast iron from the arc furnace 1

| | |
|---|---|
| Carbon | 3.86 to 3.92% |
| Silicon | 1.60 to 1.92% |
| Phosphorus | 0.020 to 0.026% |
| Manganese | 0.05 to 0.06% |
| Chromium | 0.007 to 0.016% |
| Copper | 0 to 0.003% |
| Nickel | 0.025 to 0.031% |
| Vanadium | 0.013 to 0.057% |

the balance being principally iron accompanied by a small amount of other metals.

(b) Partial analysis of the cast iron of the pipes

| | | |
|---|---|---|
| Silicon | 2.07 to 2.14% | (it is higher than that of the base cast iron following on the inoculating treatment) |
| Magnesium | 0.022 to 0.023% | (it appears following on the nodulizing treatment) |

(c) Structure of the pipes after industrial tempering.

The graphite is spheroidal at more than 80% and nodular at more than 17% (the nodular graphite has a shape defined in the French Standard NF 32201, which is a little less evenly round than the shape of spheroidal graphite).

The structure is substantially wholly ferritic.

These results, which are comparable to the usual results for centrifugally cast pipes of ductile cast iron processed or prepared in a blast furnace, followed by a reheating in the mixer and inoculation and nodulization treatments, are therefore satisfactory.

As before, the cast iron may be subjected to a pearlitization.

This second example therefore shows that the process of the invention is perfectly capable of supplying ductile cast iron to machines centrifugally casting pipes.

Having now described my invention what I claim as new and desire to secure by Letters Patent is:

1. A process for preparing cast iron containing very low amounts of chromium, manganese, vanadium and titanium from pre-reduced ores containing iron oxide and chromium, manganese, vanadium and titanium oxides, comprising the steps of (a) supplying an electric arc furnace with said pre-reduced ores and fluxes so as to form a bath of metal and slag;

(b) adding carbon to the bath in a controlled manner so as to limit the reduction of chromium, manganese, vanadium and titanium;

(c) removing the slag by cleaning;

(d) adding carbon to the cleaned bath to bring the carbon content of cast iron to the desired value; and (e) pouring the cast iron from the furnace.

2. A process for preparing ductile iron from pre-reduced ores containing iron oxide and chromium, manganese, vanadium and titanium oxides, comprising the steps of (a) supplying an electric arc furnace with fluxes and said pre-reduced ores so as to form a bath of metal and slag;

(b) adding carbon to the bath in a controlled manner so as to limit the reduction of chromium, manganese, vanadium and titanium;

(c) removing the slag by cleaning;

(d) adding carbon to the cleaned bath to bring the carbon content of cast iron to the desired value;

(e) pouring the cast iron from the furnace; and (f) subjecting the poured cast iron to a nodularizing treatment.

* * * * *